US010405578B1

(12) United States Patent
Montileone

(10) Patent No.: US 10,405,578 B1
(45) Date of Patent: Sep. 10, 2019

(54) SMOKING APPARATUS

(71) Applicant: Anthony Montileone, Saint Louis, MO (US)

(72) Inventor: Anthony Montileone, Saint Louis, MO (US)

( * ) Notice: Subject to any disclaimer, the term of this patent is extended or adjusted under 35 U.S.C. 154(b) by 82 days.

(21) Appl. No.: 15/693,893

(22) Filed: Sep. 1, 2017

Related U.S. Application Data

(60) Provisional application No. 62/382,348, filed on Sep. 1, 2016.

(51) Int. Cl.
*A24F 13/00* (2006.01)
*A24F 47/00* (2006.01)
*A24F 1/32* (2006.01)

(52) U.S. Cl.
CPC ..... *A24F 47/006* (2013.01); *A24F 1/32* (2013.01)

(58) Field of Classification Search
CPC ..... A24F 47/00
USPC ..... 313/328, 329
See application file for complete search history.

(56) References Cited

U.S. PATENT DOCUMENTS

| | | | | |
|---|---|---|---|---|
| 39,987 | A | 9/1863 | Bradford | |
| 1,336,233 | A * | 4/1920 | Ivory | A24F 1/00 131/176 |
| 1,428,446 | A | 12/1920 | Milkie | |
| 7,434,584 | B2 | 10/2008 | Steinberg | |
| 7,475,684 | B2 | 1/2009 | Balch et al. | |
| 2011/0036363 | A1 * | 2/2011 | Urtsev | A24F 47/002 131/273 |
| 2011/0094524 | A1 | 4/2011 | Glover | |
| 2013/0247767 | A1 | 9/2013 | Goldstein | |
| 2014/0174457 | A1 | 6/2014 | Merwin | |

OTHER PUBLICATIONS

Wholesale pyrex thick glass oil burner pipe smoking pipes 10mm 14mm 18mm male female bubbler oil burner for water pipes oil rigs bongs. Product listing [online]. © 2004-2018 DHgate.com [retrieved on Jun. 21, 2018]. Retrieved from the Internet: <URL: https://www.dhgate.com/product/wholesale-pyrex-thick-glass-oil-burner-pipe/396191663.html#s1-11-7b;searl|0336045074>.

* cited by examiner

*Primary Examiner* — Phuong K Dinh
(74) *Attorney, Agent, or Firm* — Cramer Patent & Design, PLLC; Aaron R. Cramer

(57) ABSTRACT

A smoking device particularly suited for smoking vaporizable oils includes a bent portion of glass tubing, a resilient metallic portion including a concentrated oil reservoir, and a swivel element interconnecting the glass tubing and metallic portion.

14 Claims, 3 Drawing Sheets

SMOKING APPARATUS

RELATED APPLICATIONS

The present invention was first described in and claims the benefit of U.S. Provisional Patent Application No. 62/382,348 filed on Sep. 1, 2016, the entire disclosures of which are incorporated herein by reference.

FIELD OF THE INVENTION

A smoking device particularly suited for smoking vaporizable oils includes a bent portion of glass tubing, a resilient metallic portion including a concentrated oil reservoir, and a swivel element interconnecting the glass tubing and metallic portion.

BACKGROUND OF THE INVENTION

There are multitude of different ways to consume a smokable product, like tobacco or *cannabis*. One (1) method finding increased favor among many users is the use of butane hash oil (BHO), which is a concentrated oil meant to be smoked with a rig, much like a bong bowl, with the use of a blowtorch. Many view this method as healthier as smoke from burning organic material is not consumed. Additionally, the resulting effect from smoking concentrated oils is very intense.

However, the actual act of smoking the oil is somewhat complicated leaving many looking for an improved pipe or rig to make the process easier. Accordingly, there exists a need for a means by which a concentrated oils can be smoked in a simpler and easier manner. The use of the smoking pipe provides users the ability to smoke concentrated oils in a manner which is quick, easy, and effective.

Many efforts have been made to address these problems such as U.S. Pat. App. Pub. No. 2014/0174457, U.S. Pat. App. Pub. No. 2011/0094524, U.S. Pat. No. 7,434,584, and U.S. Pat. No. 39,987. However, these devices are unsatisfactory in that they do not make adequately address all the aforementioned problems. Accordingly, there exists a need for a means by which a smokable oil product can be consumed in a manner which addresses these problems. The development of a smoking device particularly suited for smoking vaporizable oils fulfills this need.

SUMMARY OF THE INVENTION

In view of the foregoing disadvantages inherent in the prior art, it has been observed that there is need of a smoking device particularly suited for smoking vaporizable oils.

To achieve the above and other objectives, the present invention provides for a smoking apparatus, comprising a stummel section, a stem section and a coupling. The stummel section comprises a shank having a first and second end and a mouth at the first end and a bowl disposed beneath the mouth. The stem section comprises a first and second end. The coupling removably joins the shank second end to the stem first end. The bowl is configured to retain a fluid therein. When the shank is heated, the fluid is heated generating a vapor. The vapor may be drawn through the mouth and out the stem second end. In a separate embodiment, the coupling comprises a flat planar base suitable for resting upon a surface.

The bowl may comprise a trough located along an inner surface adjacent a top. The shank second end may comprise a first threaded portion. The stem first end may comprise a second threaded portion capable of removable attachment to the first threaded portion. The coupling may also comprise an interior threaded region at a coupling first end and a coupling second end. In this instance, the coupling threadingly secures the shank second end to the stem first end.

The shank may comprise a first bend while the stem may comprise a second and third stem. The coupling may comprise a nipple while the shank, stem and bowl may comprise metal.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
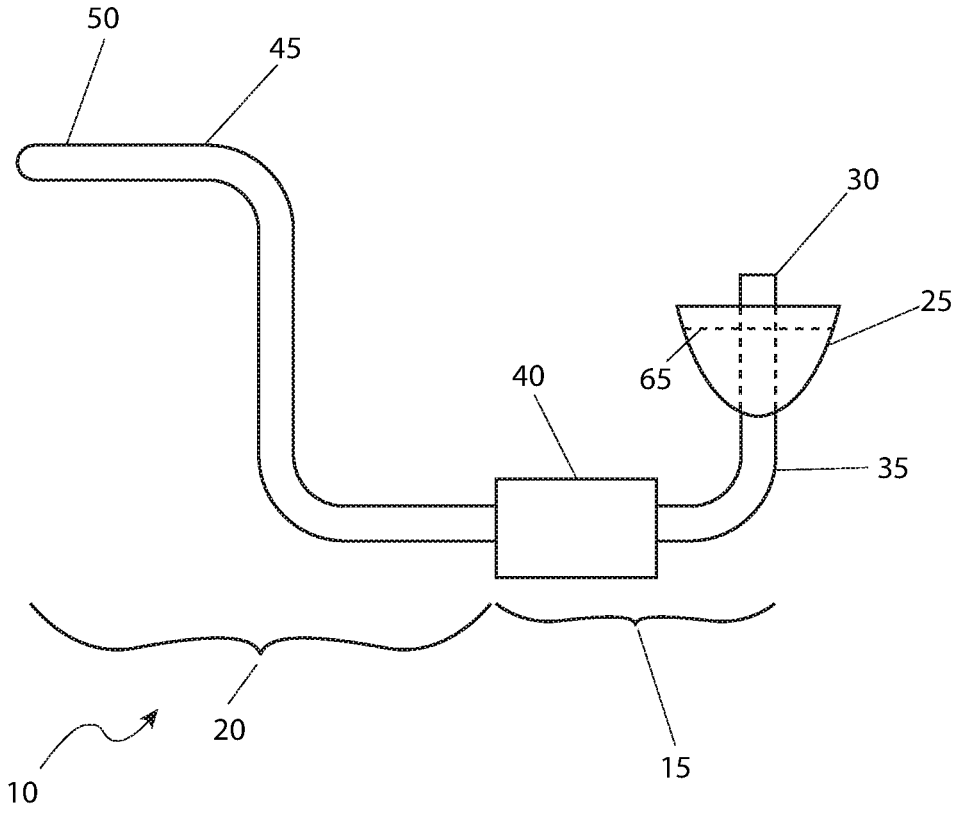
FIG. 1 is a side view of the smoking apparatus for oils 10, according to the preferred embodiment of the present invention.

10 smoking apparatus for oils
15 stummel section
20 stem section
25 bowl
30 mouth
35 shank
40 coupling
45 bit
50 lip
65 trough
80 first threaded connection
85 second threaded connection
90 connecting nipple

DETAILED DESCRIPTION OF THE PREFERRED EMBODIMENT

Figure 2:
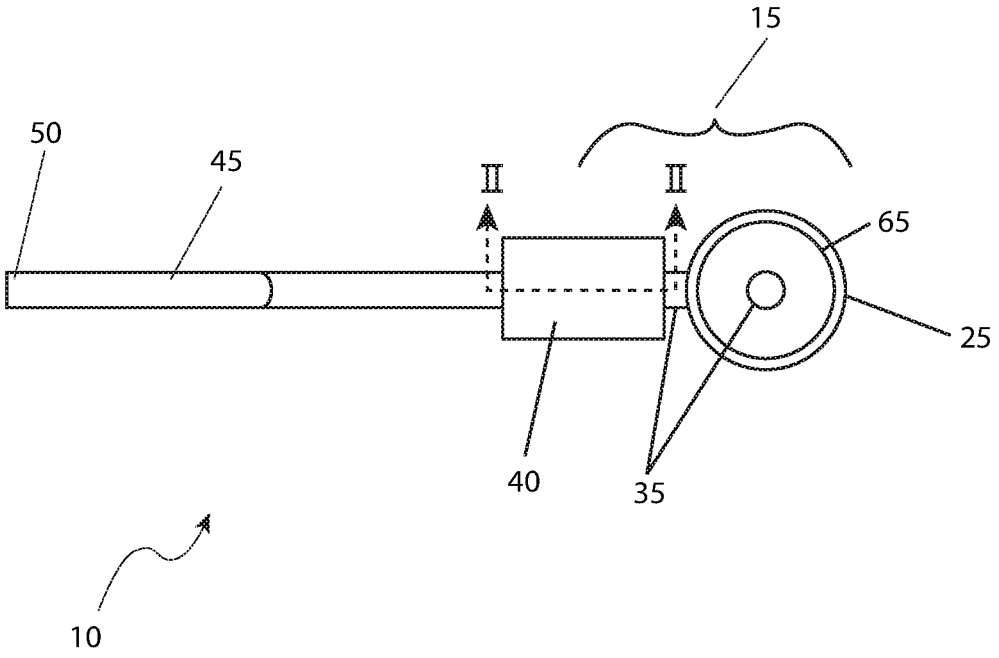
FIG. 2 is a top view of the smoking apparatus for oils 10, according to the preferred embodiment of the present invention; and, FIG. 3 is a sectional view of the smoking apparatus for oils 10, as seen along a line II-II, as shown in FIG. 2, according to the preferred embodiment of the present invention.
Figure 3:
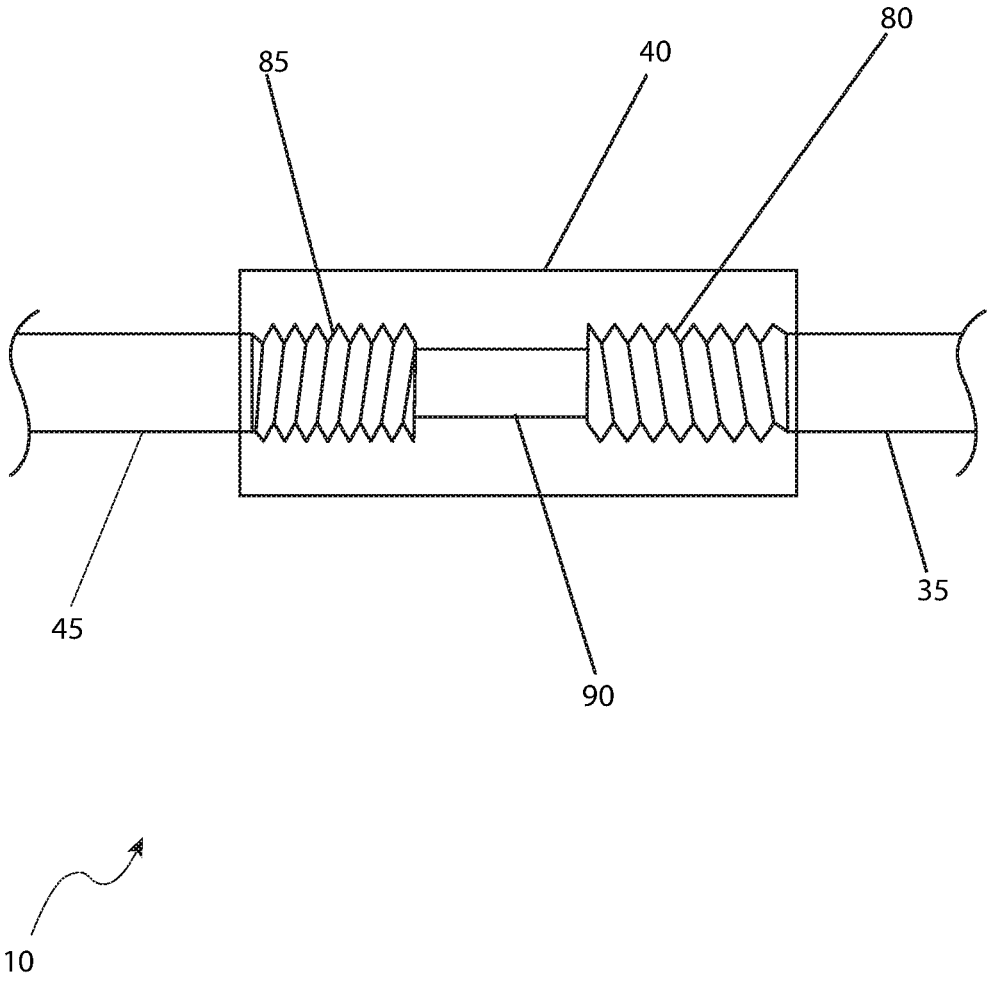

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, a side view of the smoking apparatus for oils 10, according to the preferred embodiment of the present invention, is disclosed. The smoking apparatus for oils 10 (herein described as the "apparatus") 10, is generally smoking pipe-like in appearance and consists of a stummel section 15 and a stem section 20, as would customarily be expected. The stummel section 15 provides for a bowl 25 with a trough 65 located along an inner surface adjacent the top of the bowl 25, and a shank 35 having an open mouth 30 at a distal end of the shank 35. The configuration and operation of the shank 35 will be described in greater detail herein below. The lower portion of the bowl 25 transitions into the shank 35 which terminates in a coupling 40. The coupling 40 will be described in greater detail herein below. The shank 35 is provided with the customary components of a bit 45 and a lip 50 to which allow the user to consume the products of smoking. It is envisioned that the bowl 25, the shank 35, the coupling 40, the bit 45 and the lip 50 would be made of titanium or a titanium alloy, however other materials such as steel, stainless steel, glass, plastic or the like could be used for some and/or all of the components, and as such, the inclusion or exclusion of certain construction materials should not be interpreted as a limiting factor of the present invention.

The stem section 20 is generally "Z"-shaped in appearance, although specific configurations can be altered without impacting the general functionality or learnings of the present invention. It is envisioned that the overall length of the apparatus 10 is approximately eight inches (8 in.) long. The interior opening of the shank 35 and the bit 45 would be approximately one-quarter inch (¼ in.) in diameter. During use of the apparatus 10, the user would heat the shank 35 with a blowtorch or other suitable heating device. A drop of concentrated oil is then placed in the trough 65 of the bowl 25. The resulting smoke is inhaled through the apparatus. It is also envisioned that the dimensions, weight, and physical relationship of the coupling 40 would allow it to serve as a stand when the apparatus 10 is placed upon a table or other horizontal surface.

Referring next to FIG. 2, a top view of the apparatus 10, according to the preferred embodiment of the present invention is depicted. This view provides a clearer display of the bowl 25 portion of the stummel section 15. The shank 35 is centrally located as shown. A clear air/smoke path is then provided through the lower portion of the bowl 25, through the shank 35, the coupling 40, and the bit 45 where it terminates at the lip 50. It is envisioned that the shank 35 is attached to the bottom of the bowl 25 by a threaded connection allowing said shank 35 to be removed for cleaning, replacement, or other purposes.

Referring finally to FIG. 3, a sectional view of the apparatus 10, as seen along a line II-II, as shown in FIG. 2, according to the preferred embodiment of the present invention is disclosed. This view clearly depicts the connection between the shank 35 and the bit 45 afforded by the coupling 40. The shank 35 is connected to the coupling 40 by a first threaded connection 80, while the bit 45 is connected to the coupling 40 by a second threaded connection 85. An open space between the first threaded connection 80 and the second threaded connection 85 is provided by a connecting nipple 90 to permit unrestricted transfer of the smoke/air mixture. The disassembly functionality provided by the coupling 40 affords the user the ability to easily clean the shank 35 and the bit 45 of residue should it be necessary. Additionally, any damaged or broken components of the apparatus 10 can be easily replaced, without replacement of the entire apparatus 10.

The preferred embodiment of the present invention can be utilized by the common user in a simple and effortless manner with little or no training. It is envisioned that the apparatus 10 would be constructed in general accordance with FIG. 1 through FIG. 3. Various metal forming methods used in the finishing of titanium and/or titanium alloys would be utilized.

Upon procurement of the apparatus 10 it would be ready for use by the common user with a minimal amount of discussion. First, the user would prepare the concentrated oil to be dropped on to the top surface of the trough 65 assuring that it is within reach and can be accessed by one (1) hand. Next, the user would hold the apparatus 10 by the coupling 40 using one (1) hand. Next, the user would make sure that there is nothing in the nearby area that can come in contact with or be caused harm by heat or flame. Next, using a hand-held torch or equivalent heating method, the shank 35 and bottom of the bowl 25 would be heated until orange in color. Next, the hand-held torch or equivalent heating method is set aside making sure that it does not contact any undesired surface or item, due to the barrel of said heating device being hot as well. Next, using any preferred delivery method, the user would place the concentrated oil in the trough 65 of the bowl 25, thus producing an air/smoke mixture. Next, the air/smoke mixture is inhaled through the shank 35, the coupling 40, the bit 45, and the lip 50 whereupon it is consumed in the user's lungs. Finally, after holding the air/smoke mixture is held in the user's lungs for an approximate period of two to five seconds (2-5 s), the user would exhale the air/smoke mixture out.

The above described process is then repeated on an as-desired basis in a continual manner. After one (1) or many usage cycles, the apparatus 10 may be disassembled at the coupling 40 connection point for cleaning purposes.

The exact specifications, materials used, and method of use may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A smoking apparatus, comprising:

a stummel section, further comprising:

a shank comprising:

a shank first end;

a shank second end; and, a mouth disposed at said shank first end;

a bowl disposed beneath said mouth;
a stem section comprising:
a stem first end;
a stem second end; and,
a coupling;
wherein said coupling removably joins said shank second end to said stem first end;
wherein said bowl is configured to retain a fluid therein;
wherein when said shank is heated, said fluid is heated generating a vapor; and,
wherein said vapor may be drawn through said mouth and out said stem second end;
wherein said shank second end comprises a first threaded portion;
wherein said stem first end comprises a second threaded portion capable of removable attachment to said first threaded portion;
wherein said shank, said stem and said bowl comprise metal.

2. The apparatus of claim 1, wherein said bowl comprises a trough located along an inner surface adjacent a top thereof.

3. The apparatus of claim 1, wherein said coupling comprises an interior threaded region at a coupling first end and a coupling second end;
wherein said coupling threadingly secures said shank second end to said stem first end.

4. The apparatus of claim 1, wherein said shank comprises a first bend.

5. The apparatus of claim 4, wherein said stem comprises a second bend.

6. The apparatus of claim 5, wherein said stem comprises a third bend adjacent said second bend.

7. The apparatus of claim 1, wherein said coupling further comprises a nipple.

8. A smoking apparatus, comprising:
a stummel section, further comprising:
a shank comprising:
a shank first end;
a shank second end; and,
a mouth disposed at said shank first end;
a bowl disposed beneath said mouth;
a stem section comprising:
a stem first end;
a stem second end; and,
a coupling having a planar base;
wherein said coupling removably joins said shank second end to said stem first end;
wherein said bowl is configured to retain a fluid therein;
wherein when said shank is heated, said fluid is heated generating a vapor;
wherein said vapor may be drawn through said mouth and out said stem second end;
wherein when not in use, said apparatus is capable of resting upon said planar base upon a surface;
wherein said shank second end comprises a first threaded portion;
wherein said stem first end comprises a second threaded portion capable of removable attachment to said first threaded portion;
wherein said shank, said stem and said bowl comprise metal.

9. The apparatus of claim 8, wherein said bowl comprises a trough located along an inner surface adjacent a top thereof.

10. The apparatus of claim 8, wherein said coupling comprises an interior threaded region at a coupling first end and a coupling second end;
wherein said coupling threadingly secures said shank second end to said stem first end.

11. The apparatus of claim 8, wherein said shank comprises a first bend.

12. The apparatus of claim 11, wherein said stem comprises a second bend.

13. The apparatus of claim 12, wherein said stem comprises a third bend adjacent said second bend.

14. The apparatus of claim 8, wherein said coupling further comprises a nipple.

* * * * *